US010150306B2

(12) United States Patent
Sakamoto et al.

(10) Patent No.: US 10,150,306 B2
(45) Date of Patent: Dec. 11, 2018

(54) DRYING DEVICE, CONTROL DEVICE, AND DRYING METHOD

(71) Applicants: Wataru Sakamoto, Tokyo (JP); Toshihiro Yoshinuma, Kanagawa (JP)

(72) Inventors: Wataru Sakamoto, Tokyo (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/652,478

(22) Filed: Jul. 18, 2017

(65) Prior Publication Data

US 2018/0022114 A1 Jan. 25, 2018

(30) Foreign Application Priority Data

Jul. 20, 2016 (JP) ..... 2016-142131
Jul. 7, 2017 (JP) ..... 2017-134156

(51) Int. Cl.

| | |
|---|---|
| ***B41J 11/00*** | (2006.01) |
| ***B41F 23/04*** | (2006.01) |
| ***G03G 15/20*** | (2006.01) |
| ***B41M 7/00*** | (2006.01) |
| ***F26B 3/18*** | (2006.01) |

(52) U.S. Cl.

CPC ..... *B41J 11/002* (2013.01); *B41F 23/0459* (2013.01); *B41F 23/0486* (2013.01); *B41J 11/0095* (2013.01); *B41M 7/00* (2013.01); *F26B 3/18* (2013.01); *G03G 15/2053* (2013.01)

(58) Field of Classification Search

CPC . B41J 11/002; B41J 11/0095; G03G 15/2053; B41F 23/0486; B41F 23/0459; B41M 7/00

See application file for complete search history.

(56) References Cited

U.S. PATENT DOCUMENTS

| | | | | |
|---|---|---|---|---|
| 8,090,273 | B2 * | 1/2012 | Derimiggio ..... | G03G 15/50 399/12 |
| 8,909,084 | B2 | 12/2014 | Fujii | |
| 2016/0273832 | A1 | 9/2016 | Asada et al. | |

FOREIGN PATENT DOCUMENTS

| | | |
|---|---|---|
| JP | 5561266 | 7/2014 |
| JP | 2016-173191 | 9/2016 |

* cited by examiner

*Primary Examiner* — Julian D Huffman
(74) *Attorney, Agent, or Firm* — IPUSA, PLLC

(57) ABSTRACT

A drying device includes a roller, and the drying device is for drying a recording medium conveyed by rotation of the roller. The drying device includes a first heating source and second heating source included inside the roller; first and second temperature detectors for respectively detecting a temperature of a first region on a surface of the roller and a temperature of a second region on the surface of the roller; and a heating controller that controls heating and termination of the heating by the first heating source and/or the second heating source, wherein, upon detecting that a temperature of one region of the first region and the second region is higher than or equal to a predetermined temperature, the heating controller terminates heating by one heating source corresponding to the other region.

9 Claims, 8 Drawing Sheets

DRYING DEVICE, CONTROL DEVICE, AND DRYING METHOD

BACKGROUND OF THE INVENTION

1. Field of the Invention

The present disclosure relates to a drying device, a control device, a drying system, and a drying method.

2. Description of the Related Art

A drying device has been known that is for drying, by using a heating roller including a heat source, such as a halogen lump, a recording medium to which ink or a processing liquid is applied.

In such a drying device, by introducing halogen lamps provided with respective different light emitting regions, an increase in temperature at a non-sheet passing part corresponding to a sheet width is suppressed. Specifically, a technique has been known that is for controlling temperature of a heating roller, for example, by allocating heating lamps so as to correspond to paper sizes and by using a temperature sensor installed at an outer end of a sheet passing area.

In recent years, various types of recording media have been developed. Accordingly, in the above-described technique, a number of heating sources and heating (light emitting) regions are provided so as to correspond to widths of the recording media. Accordingly, it is difficult to suppress an increase in temperature of each of non-sheet passing parts corresponding to recording media having various widths.

There is a need for a technique with which an increase in temperature of a non-sheet passing part can be suppressed.

SUMMARY OF THE INVENTION

According to an aspect of the present disclosure, there is provided a drying device provided with a roller, wherein the drying device is for drying a recording medium conveyed by rotation of the roller, the drying device including a first heating source and a second heating source that are included inside the roller; a second heating source; a first temperature detector configured to detect a temperature of a first region on a surface of the roller, the first region being heated by the first heating source; a second temperature detector configured to detect a temperature of a second region on the surface of the roller, the second region being heated by the second heating source; and a heating controller configured to control heating and termination of the heating by the first heating source and the second heating source, wherein, upon detecting that a temperature of one region of the first region and the second region is higher than or equal to a predetermined temperature, the heating controller is configured to terminate heating by one heating source of the first heating source and the second heating source, the one heating source corresponding to the other region.

According to another aspect of the present disclosure, there is provided a control device for controlling a drying device including a roller, a first heating source and a second heating source being included inside the roller, wherein the drying device is for drying a recording medium conveyed by rotation of the roller, the control device including a temperature obtaining unit configured to obtain a temperature of a first region and a temperature of a second region, wherein the temperature obtaining unit is configured to obtain the temperature of the first region from a first temperature detector configured to detect the temperature of the first region on a surface of the roller, the first region being heated by the first heating source, and wherein the temperature obtaining unit is configured to obtain the temperature of the second region from a second temperature detector configured to detect the temperature of the second region on the surface of the roller, the second region being heated by the second heating source; and a heating controller, wherein, upon detecting that a temperature of one region of the first region and the second region is higher than or equal to a predetermined temperature, the heating controller is configured to terminate heating by one heating source of the first heating source and the second heating source, the one heating source corresponding to the other region.

According to another aspect of the present disclosure, there is provided a drying system including a printing device for forming an image on a recording medium and a drying device including a roller, wherein the drying device is for drying the recording medium conveyed by rotation of the roller, wherein the drying device includes a first heating source and second heating source that are included inside the roller; a first temperature detector configured to detect a temperature of a first region on a surface of the roller, the first region being heated by the first heating source; a second temperature detector configured to detect a temperature of a second region on the surface of the roller, the second region being heated by the second heating source; and a heating controller configured to control heating and termination of the heating by the first heating source and/or the second heating source, wherein, upon detecting that a temperature of one region of the first region and the second region is higher than or equal to a predetermined temperature, the heating controller is configured to terminate heating by one heating source of the first heating source and the second heating source, the one heating source corresponding to the other region.

According to another aspect of the present disclosure, there is provided a drying method for use in a drying device, wherein the drying device includes a roller, a first heating source and a second heating source being included inside the roller, wherein the drying device is for drying a recording medium conveyed by rotation of the roller, the drying method including obtaining, by the drying device, a temperature of a first region and a temperature of a second region, wherein the temperature of the first region is obtained from a first temperature detector for detecting the temperature of the first region on a surface of the roller, the first region being heated by the first heating source, and wherein the temperature of the second region is obtained from a second temperature detector for detecting the temperature of the second region on the surface of the roller, the second region being heated by the second heating source; and upon detecting that a temperature of one region of the first region and the second region is higher than or equal to a predetermined temperature, terminating, by the drying device, heating by one heating source of the first heating source and the second heating source, the one heating source corresponding to the other region.

According to an embodiment of the present disclosure, an increase in temperature of a non-sheet passing part can be suppressed.

Other objects, features and advantages of the present disclosure will become more apparent from the following detailed description when read in conjunction with the accompanying drawings.

DETAILED DESCRIPTION OF THE PREFERRED EMBODIMENTS

Figure 1:
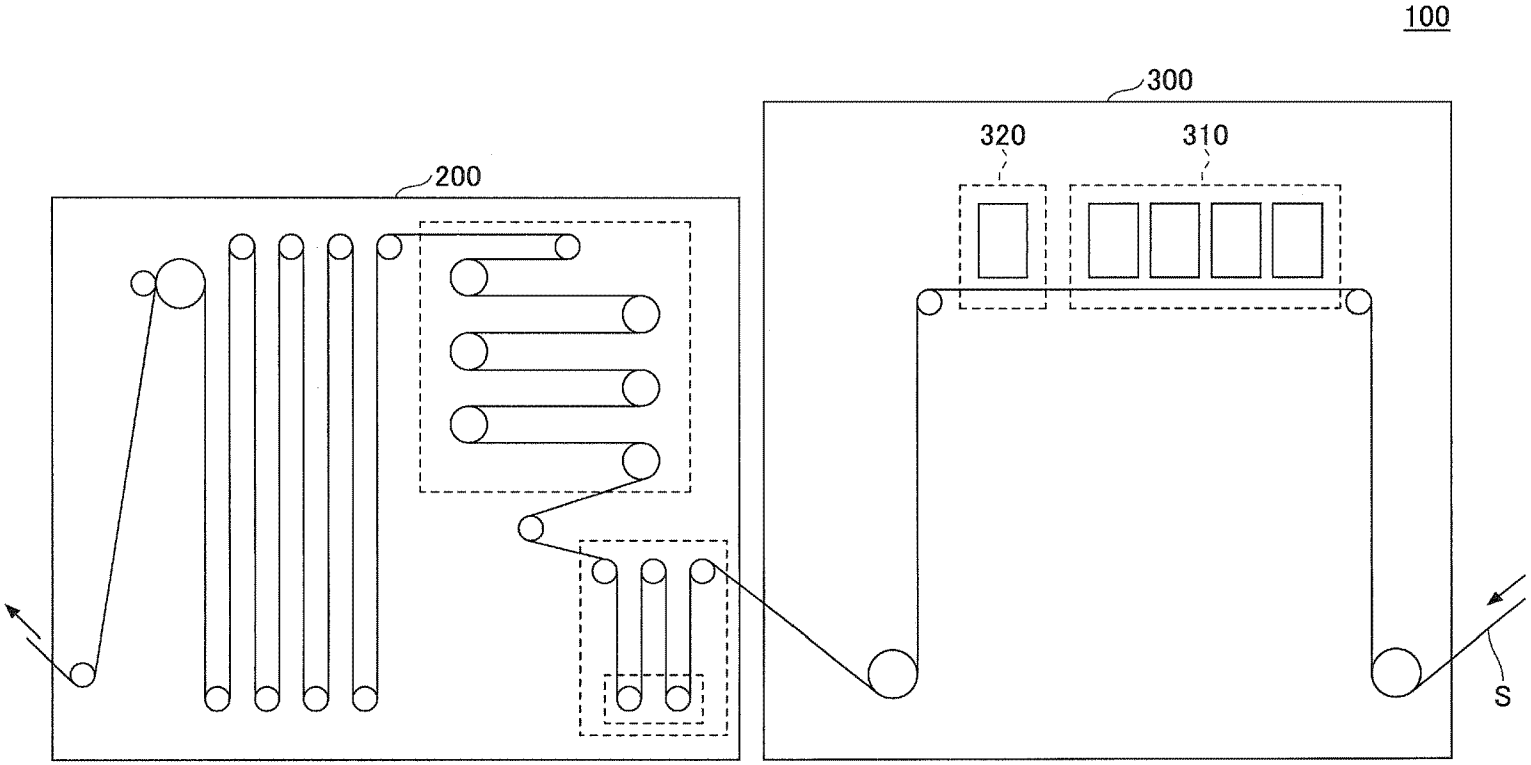
FIG. 1 is a diagram illustrating an example of a drying system.

In the following, an embodiment is described by referring to the drawings. FIG. 1 is a diagram illustrating an example of a drying system.

The drying system 100 according to the embodiment includes a drying device 200 and a printing device 300. The drying device 200 according to the embodiment is coupled to the printing device 300 located at an upstream side in a sheet conveyance direction with respect to the drying device 200.

The printing device 300 according to the embodiment includes a printing unit 310 and a drying unit 320. In the printing device 300, a recording medium S that is conveyed to the printing device 300 is conveyed to the printing unit 310 through a conveyance roller and a guide roller. The printing unit 310 includes an inkjet head for discharging ink. Here, a distance between the inkjet head and the recording medium S is adjusted to be approximately from 1 mm to 2 mm.

The drying unit 320 according to the embodiment suppresses the occurrence of ink transfer (picking). Picking occurs when the ink discharged on a printing surface of the recording medium S contacts various rollers. Picking is a phenomenon such that ink is transferred from a recording medium to a roller by contacting the recording medium with the roller in a short time period, due to an undried state of the printing surface. Note that, as a phenomenon in which ink is transferred, other than picking, there is blocking. Blocking is a phenomenon in which ink is transferred to a recording medium in a state where high pressure is applied to the recording medium. The state in which the high pressure is applied to the recording medium is, for example, a state in which the recording medium is overlapped or a state in which the recording medium is wound up.

In the drying system 100 according to the embodiment, blocking is suppressed in the drying device 200.

Figure 2:
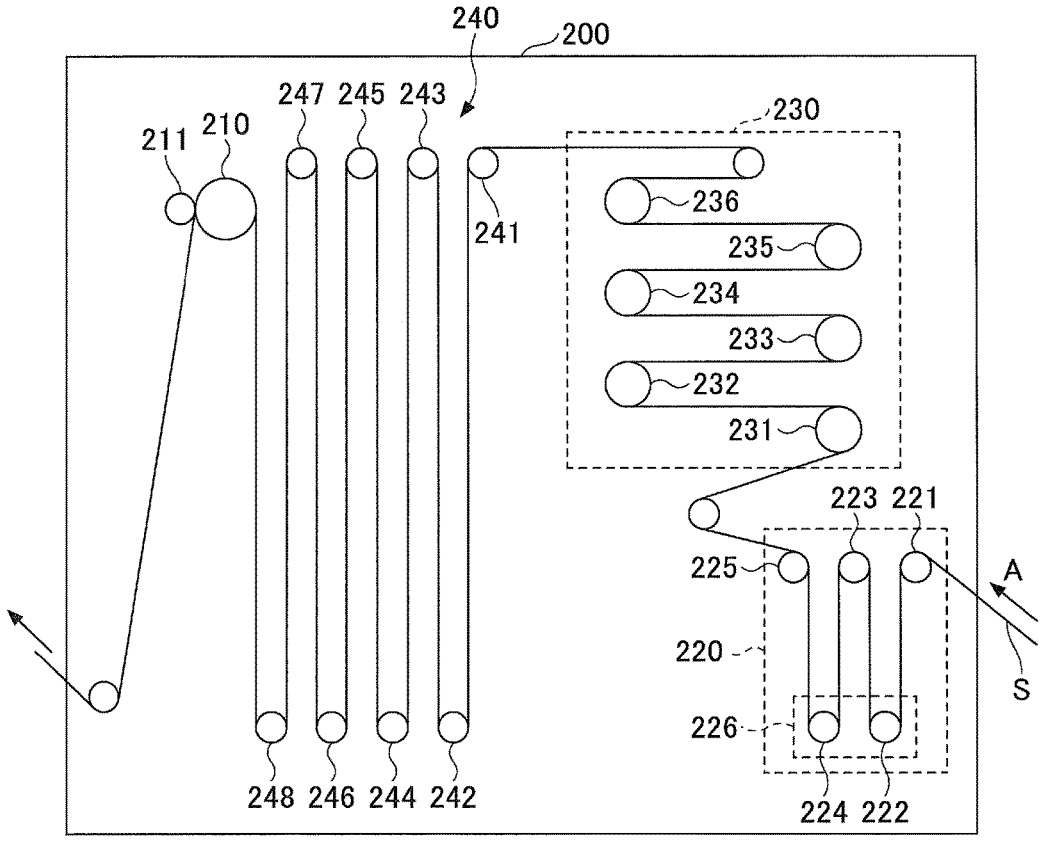
FIG. 2 is a diagram illustrating an example of a drying device.

The drying device 200 according to the embodiment is described below by referring to FIG. 2. FIG. 2 is a diagram illustrating the drying device.

The drying device 200 according to the embodiment includes a conveyance roller 210 for conveying the recording medium S. The conveyance roller 210 is located at a downstream side in the sheet conveyance direction within the drying device 200. By the conveyance roller 210, the recording medium S is conveyed in the sheet conveyance direction, which is shown by the arrows in the figure.

Furthermore, the drying device 200 according to the embodiment includes a buffer unit 220; a drying unit 230; and a cooling unit 240.

The buffer unit 220 is located at an upstream side in the sheet conveyance direction of the recording medium S inside the drying device 200. The buffer unit 220 is for ensuring a predetermined amount of the recording medium S in the vicinity of the entrance, from which the recording medium S is fed inside the drying device 200.

The buffer unit 220 according to the embodiment is provided with a plurality of rollers 221, 222, 223, 224, 225, and 226 (which are respectively denoted as 221 through 226 below). The recording medium S is wound around the plurality of rollers 221 through 226.

In the drying device 200, during conveyance of the recording medium S, rotational speed of the conveyance roller 210 is controlled, so that a predetermined amount of the recording medium S is accumulated in the buffer unit 220 and the accumulated recording medium S is conveyed at constant speed.

In the buffer unit 220 according to the embodiment, among the rollers 221 through 226, the two rollers 222 and 224 located at a lower part of the drying device 200 may be configured, so that the rollers 222 and 224 can move upward and downward. In this case, in the buffer unit 220 according to the embodiment, the amount of the recording medium S accumulated in the buffer unit 220 may be varied by varying the positions of the rollers 222 and 224. The recording medium S conveyed from the buffer unit 220 is conveyed to the drying unit 230.

The drying unit 230 according to the embodiment includes a plurality of heating rollers 231, 232, 233, 234, 235, and 236 (which are denoted as 231 through 236 below). The heating rollers 231 through 236 are arranged in a zigzag pattern, and the recording medium S is wound around the plurality of rollers 231 through 236. Each of the heating rollers 231 through 236 includes therein a halogen lamp as a heat source. Each halogen lamp is controlled by a control device, which is described below.

In the drying device 230 according to the embodiment, the recording medium S is dried by heat transfer that occurs upon the recording medium S contacting each of the heating rollers (rollers) 231 through 236. Furthermore, each of the heating rollers (rollers) 231 through 236 according to the embodiment conveys the recording medium S by being rotated.

For the heating rollers 231 through 236 according to the embodiment, more heating capability with respect to the recording medium S is required, as the position of the heating roller is located at an upstream side in the conveyance direction of the recording medium S. The reason is that the heating roller located at an upstream side is deprived of heat by the recording medium S, which is a base material, so that heat is not supplied to the ink on the recording medium S. In the following description, a heating roller located at an upstream side in the sheet conveyance direction is referred to as an upstream heating roller.

In the drying unit 230 according to the embodiment, a temperature of the recording medium S is raised to a certain temperature by the heat of the upstream heating roller. Then, in the drying unit 230, ink on the recording medium S is dried mainly by heat of a downstream heating roller located at a downstream side with respect to the upstream heating roller in the sheet conveyance direction of the recording medium S. In the following description, a heating roller located at a downstream side in the sheet conveyance direction is referred to as the downstream heating roller.

Furthermore, in the embodiment, the upstream heating rollers refer to the heating rollers 231 and 232, for example. The downstream heating rollers refer to the heating rollers 233, 234, 235, and 236, for example.

Note that, in the embodiment, the downstream heating rollers are four rollers, which are the heating rollers 233 through 236. However, the number of the downstream heating rollers is not limited to this. For example, the number of the downstream heating rollers may be two or six. The number of the downstream heating rollers may be any number, provided that ink on the recording medium S can be sufficiently dried by the downstream heating rollers. Furthermore, if the ink on the recording medium S can be sufficiently dried without providing the downstream heating rollers, the downstream heating rollers may not be provided.

Furthermore, the region of the drying unit 230 forms a closed space. A heat insulating material is formed around the drying unit 230, and heat is insulated so as not to leak the heat inside the drying unit 230 to outside the drying unit 230. Consequently, the inner part of the drying unit 230 is a space with a high temperature, compared to the surroundings of the drying unit 230.

Namely, in the drying unit 230 according to the embodiment, the space inside the drying unit 230 is heated by using the heat generated from the heating rollers 231 through 236. Consequently, in the drying unit 230 according to the embodiment, the recording medium S can be dried with the high-temperature air in the space among the heating rollers 231 through 236. Consequently, in the embodiment, it is not required to use a space heater for heating the space. The recording medium S conveyed from the drying unit 230 is conveyed to the cooling unit 240.

The cooling unit 240 according to the embodiment includes a plurality of guide rollers 241, 242, 243, 244, 245, 246, 247, and 248 (which are denoted as 241 through 248 below). The guide rollers 241 through 248 are arranged zigzag, and the recording medium S is wound around the plurality of rollers 241 through 248. The recording medium S conveyed from the drying unit 230 is cooled by being conveyed among the plurality of guide rollers 241 through 248.

In the space of the cooling unit 240 according to the embodiment, a temperature of the recording medium S can be controlled by spraying outside air, or by changing a conveyance distance. The recording medium S conveyed from the cooling unit 240 is conveyed outside the drying device 200 after passing through a nip between the conveyance roller 210 and a nip roller 211.

Figure 3:
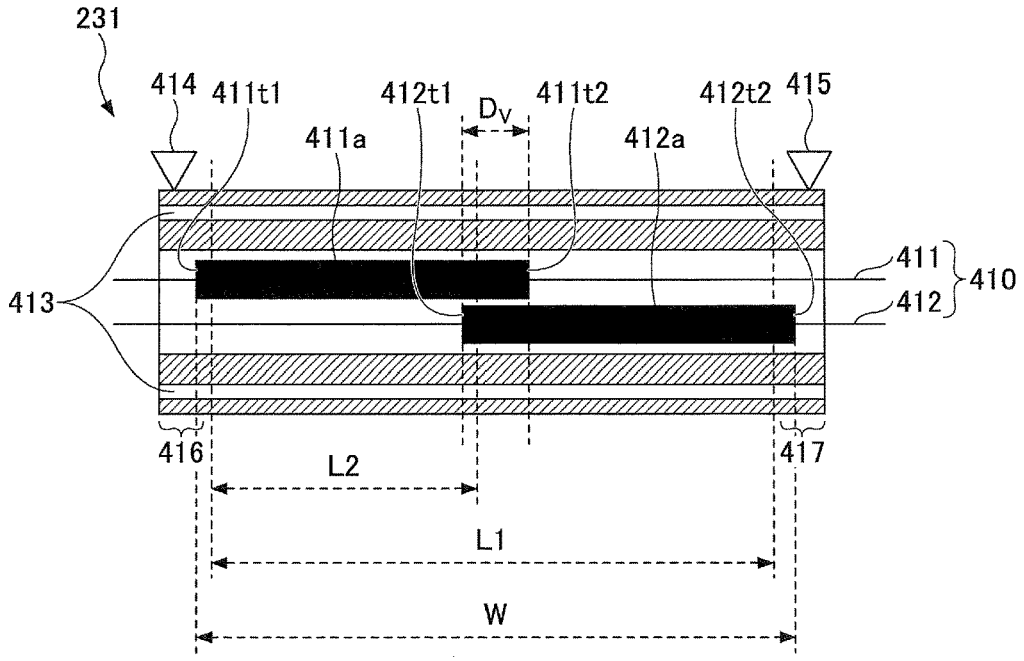
FIG. 3 is a diagram illustrating an upstream heating roller in the drying device.

Next, by referring to FIG. 3, specific configurations of the heating rollers 231 and 232 are described, which are the upstream rollers in the embodiment. FIG. 3 is a diagram illustrating the upstream heating roller in the drying device 200.

Note that the heating rollers 231 and 232 are configured to be the same. Thus, in FIG. 3, out of the heating rollers 231 and 232, the heating roller 231 located at an upstream most position in the sheet conveyance direction of the recording medium S is described, and the description of the heating roller 232 is omitted.

Furthermore, in the configuration of the heating roller 231 described by referring to FIG. 3, an edge of the recording medium S (the edge of the recording medium S at the left side in FIG. 3) is defined to be a reference of conveyance (conveyance reference). However, the conveyance reference is not limited to this. The conveyance reference applied to the drying device 200 according to the embodiment may not be the edges of the recording medium S.

The heating roller 231 according to the embodiment includes therein two halogen lamps 411 and 412 as a heat source 410 of the heating roller 231.

The halogen lamp 411 is a first hearing source for heating the heating roller 231 at the side of the conveyance reference. The halogen lamp 412 is a second hearing source for heating the heating roller 231 at the side opposite to the side of the conveyance reference.

The halogen lamp 411 includes a light emitting range 411*a*, which is a first light emitting region. The halogen lamp 412 includes a light emitting range 412*a*, which is a second light emitting region.

The light emitting range 412*a* of the halogen lamp 412 includes a light emitting region that is the same as the light emitting region of the light emitting range 411*a*. In the width direction of the heating roller 231, the light emitting range 412*a* includes a range that overlaps a part of the light emitting range 411*a*.

In the embodiment, a length of each of the light emitting range 411*a* and the light emitting range 412*a* in the heating roller 231 is adjusted to be slightly greater than the half of the length of the heating roller 231 in a direction of an axis of the heating roller 231.

The part of the light emitting range 411*a* overlaps the part of the light emitting range 412*a* at a central part in the direction of the axis of the heating roller 231. In the following description, the parts of the light emitting range 411*a* and the light emitting range 412*a* that overlap in the direction of the axis of the heating roller 231 is referred to as an overlap part Ov. The overlap part Ov according to the embodiment is formed by arranging the halogen lamps 411 and 412, so that the light emitting range 411*a* and the light emitting range 412*a* are adjacent to each other in the vicinity of the central part in the direction of the axis of the heating roller 231. Furthermore, in the heating roller 231 according to the embodiment, the light emitting range 411*a* and the light emitting range 412*a* occupy the range corresponding to the maximum width L1 of the recording medium S. As illustrated in FIG. 3, one end part of the light emitting range 411*a* is an end part 411*t*1 and the other end part of the light emitting range is an end part 411*t*2, and one end part of the light emitting range 412*a* is an end part 412*t*1 and the other end part of the light emitting range 412*a* is an end part 412*t*2. In the embodiment, the halogen lamp 411 and the halogen lamp 412 are arranged, so that, the width W from the end part 411*t*1 to the end part 412*t*2 is greater than or equal to the maximum width L1 of the recording medium S. Namely, in the embodiment, the halogen lamp 411 and the halogen lamp 412 are arranged, so that the end part 411*t*1 of the light emitting range 411*a* is in the vicinity of one edge of the heating roller 231 and the end part 412*t*2 of the light emitting range 412*t*2 is in the vicinity of the other edge of the heating roller 231.

A part heated by the halogen lamp 411 differs from a part heated by the halogen lamp 412. However, a supplied heat amount per unit length by the halogen lamp 411 is equal to a supplied heat amount per unit length by the halogen lamp 412. In each of the halogen lamps 411 and 412 according to the embodiment, the supplied heat amount per unit length at the overlap part Ov of the light emitting ranges 411*a* and 412*a* per halogen lamp is adjusted to be a half of the supplied heat amount per unit length from the part other than the overlap part Ov.

Furthermore, in the embodiment, the inner part of the heating roller 231 includes a heat pipe 413, so that a temperature distribution in the direction of the axis of the heating roller 231 becomes uniform. In the embodiment, by including the heat pipe 413 in the heating roller 231, the heating roller 231 can be uniformly heated toward both ends in the direction of the axis of the heating roller 231.

Furthermore, in the embodiment, in order to detect a surface temperature of the heating roller 231, non-contact type temperature sensors 414 and 415 are provided. The temperature sensors 414 and 415 in the embodiment are thermopiles, for example.

The temperature sensor 414 is a first temperature detector for detecting a temperature of the halogen lamp 411 based on the surface temperature of the heating roller 231. The temperature sensor 415 is a second temperature detector for detecting a temperature of the halogen lamp 412 based on the surface temperature of the heating roller 231.

In the following, the positions are described at which the temperature sensors 414 and 415 according to the embodiment are installed.

The temperature sensor 414 is installed at a non-sheet passing part 416 at the edge of the heating roller 231 in the conveyance reference side. The recording medium S does not pass through the non-sheet passing part 416. The temperature sensor 415 is installed at a non-sheet passing part 417 at the edge opposite to the edge of the non-sheet passing part 416. The non-sheet passing part 417 is another non-sheet passing part of the heating roller 231. The non-sheet passing part according the embodiment is, in the other words, an area on a surface of each of heating rollers 231 and 232 that is not contacted by the recording medium S conveyed by the rotation of the heating roller. Additionally, a sheet passing part according to the embodiment is an area on the surface of each of the heating rollers 231 and 232 that is contacted by the recording medium S conveyed by the rotation of the heating roller.

In the embodiment, by installing the non-contact type temperature sensors 414 and 415 at the non-sheet passing parts of the heating roller 231, variations in the output values of the temperature sensors 414 and 415 caused by contamination of paper dust accumulated in the temperature sensors 414 and 415 are suppressed.

In the drying device 200 according to the embodiment, depending on the output values of the temperature sensors 414 and 415, on/off of light emission of the halogen lamp 411 and on/off of light emission of the halogen lamp 412 are controlled.

Note that the heating rollers 233 through 236, which are the downstream heating rollers according to the embodiment, are configured to be the same. Each of the heating rollers 233 through 236, which are the downstream heating rollers according to the embodiment, may be configured to include, for example, a halogen lamp as a heat source and a temperature sensor for detecting a surface temperature of the heating roller.

Furthermore, a heat quantity generated by the halogen lamp included in each of the heating rollers 233 through 236 may be less than the heat quantity generated by the halogen lamp included in each of the upstream heating rollers 231 and 232. As the heat quantity generated by each of the heating rollers 233 through 236 is small, the temperature sensor for detecting the surface temperature may be omitted.

A control device 500 included in the drying device 200 according to the embodiment is described below.

Figure 4:
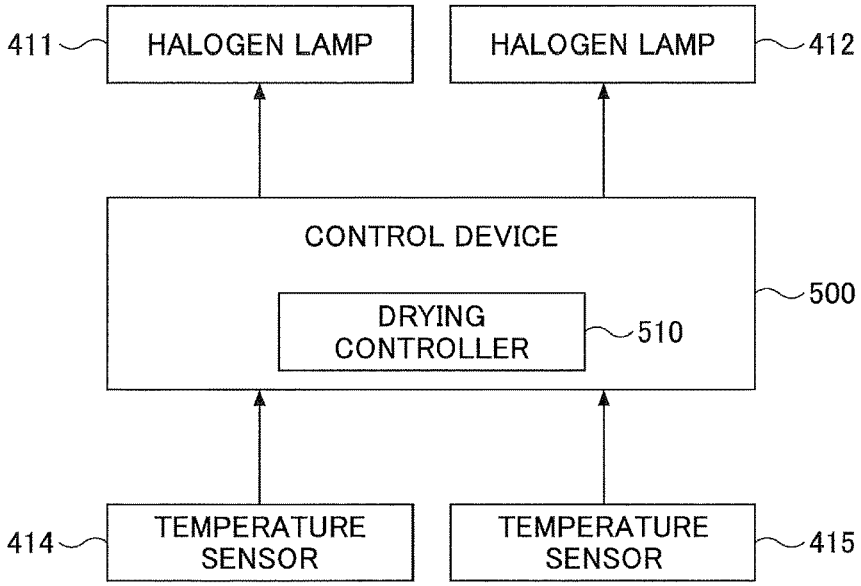
FIG. 4 is a diagram illustrating a control device.

FIG. 4 is a diagram illustrating the control device 500. The control device 500 according to the embodiment is implemented, for example, by a central processing unit (CPU) and a memory. Units of the control device 500, which are described below, are implemented by the CPU by reading out and executing a control program stored in the memory.

The control device 500 according to the embodiment includes a drying controller 510. The control device 500 controls on/off of the halogen lamps based on the temperature detected by the temperature sensors included in the heating rollers 231 through 236.

In particular, the control device 500 according to the embodiment controls on/off of the two halogen lamps included in each of the upstream heating rollers 231 and 232. FIG. 4 schematically illustrates on/off control of the halogen lamps 411 and 412 included in the heating roller 231.

In the control device 500 according to the embodiment, in response to detecting that the temperature detected by the temperature sensor 415 is higher than a preset temperature, the drying controller 510 turns off the halogen lamp 412. Furthermore, after turning off the halogen lamp 412, upon detecting that the temperature detected by the temperature sensor 415 is higher than a predetermined upper limit temperature, the drying controller 510 turns off the halogen lamp 411. Note that, if the temperature detected by the temperature sensor 415 is higher than the upper limit temperature, there is a risk of damaging the drying device 200.

In the following, a case is described in which the temperature detected by the temperature sensor 415 keeps rising, after turning off the halogen lamp in the heating roller 231.

For example, suppose that the recording medium with a sheet passing width of L2 is conveyed in the drying device 200 (cf. FIG. 3). Upon detecting that conveyance of the recording medium S is started, the control device 500 turns on the halogen lamps 411 and 412. As a result, in the heating roller 231, the light emitting ranges 411*a* and 412*a* are heated by the halogen lamps 411 and 412.

Here, the light emitting range 411*a* is deprived of heat by the recording medium S, so that the temperature of the halogen lamp 411 does not rise to the predetermined upper limit temperature, even if heating is continued. However, in this case, the light emitting range 412*a* is a non-sheet passing part, so that there is no recording medium S that absorbs heat, and the temperature of the light emitting range 412*a* rises. Additionally, there is a case in which the temperature rises in the light emitting range 412 by the heat of the halogen lamp 411, even if the halogen lamp 412 is turned off.

Thus, if the temperature rises after turning off the halogen lamp 412, which is a heat source in the light emitting range 412*a*, and the surface temperature of the heating roller 231 corresponding to the light emitting range 412*a* reaches the upper limit temperature, the control device 500 according to the embodiment also turns off the halogen lamp 411.

In the embodiment, by controlling on/off of the two halogen lamps 411 and 412 included in the heating roller 231 as described above, an increase in the temperature of the non-sheet passing part can be suppressed without depending on the width of the recording medium S. Note that, in the embodiment, the drying controller 510 may perform control to reduce a quantity of heat generated by each of the halogen lamps 411 and 412, in addition to the on/off control of the halogen lamps 411 and 412. For example, upon determining that the temperature detected by the temperature sensor 415 is higher than a predetermined temperature, the drying controller 510 may reduce a quantity of heat generated by the halogen lamp 412. After reducing the quantity of heat generated by the halogen lamp 412, upon determining that the temperature detected by the temperature sensor 415 exceeds a predetermined upper limit temperature, the drying controller 510 turns off the halogen lamp 415. Details of the method of reducing the quantity of heat generated by the halogen lamp are described below.

Note that the upper limit temperature according to the embodiment is a temperature that is higher than a target temperature of the drying device 200. At the upper limit temperature, there is a possibility that the drying device 200 may not operate normally.

Furthermore, in the embodiment, the heating roller 232 is controlled similar to the case of controlling the heating roller 231.

In the embodiment, by controlling the upstream heating rollers 231 and 232 as described above, even if, for example, in the heating roller 213, the halogen lamp for heating the sheet passing part is turned off prior to sufficiently increasing the temperature of the sheet passing part through which the recording medium S passes, the recording medium S can be heated again by the subsequent heating roller 232.

Furthermore, according to the embodiment, there are provided heating rollers 233 through 236 subsequent to the heating roller 232. Upon reaching the heating rollers 233 through 236, the temperature of the recording medium S is sufficiently high, so that the heat absorbed by the recording medium S is negligible. Consequently, it suffices if the heating rollers 233 through 236 generate a heat quantity that is smaller than the heat quantity generated by the heating rollers 231 and 232.

In the drying device 200 according to the embodiment, by the above-described configuration, a heat quantity required for drying the recording medium S can be supplied, while suppressing an increase in the temperature of the non-sheet passing part. Thus, according to the embodiment, it is possible to prevent that drying of the recording medium S becomes insufficient due to suppression of an increase in the temperature of the non-sheet passing part, and that the quality is lowered. Furthermore, according to the embodiment, on/off of the halogen lamp is controlled base on the surface temperature of the heating roller, so that the control by the control device 500 does not depend on the width of the recording medium S. Thus, according to the embodiment, a sensor for detecting the width of the recording medium S and a number of halogen lamps corresponding to the width of the recording medium S are not required, so that the cost can be reduced.

Figure 5:
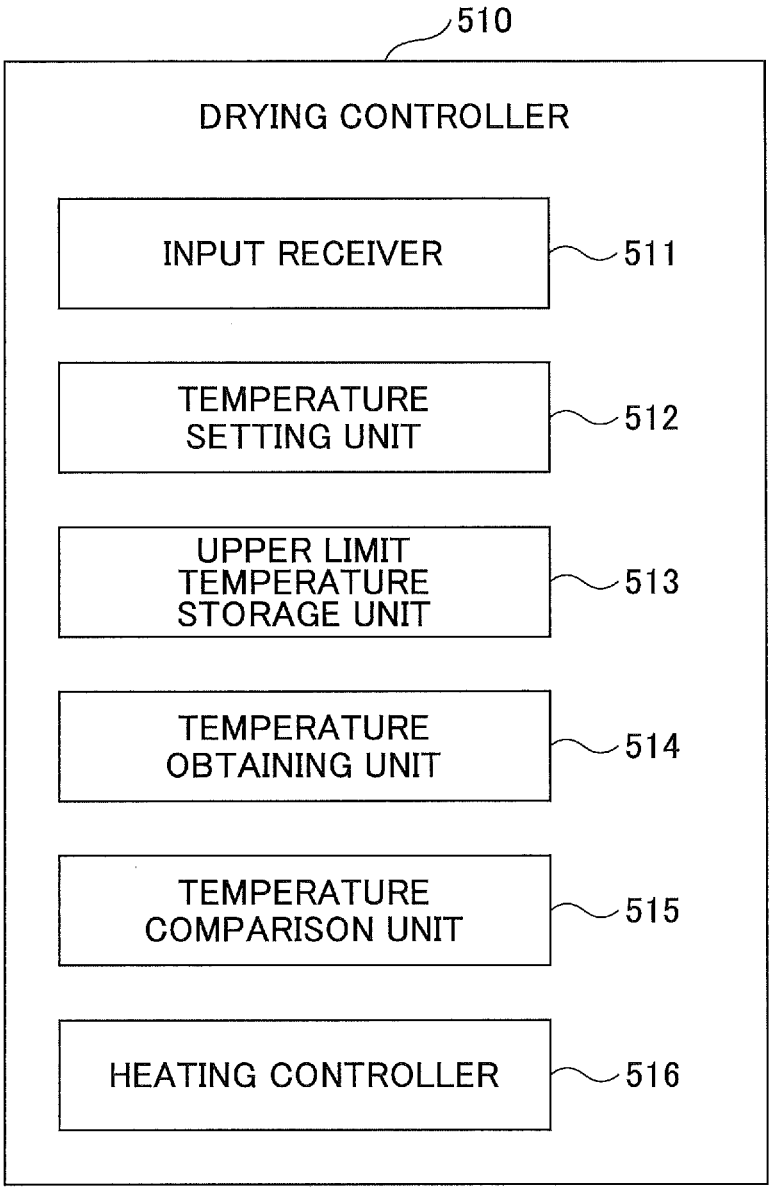
FIG. 5 is a diagram illustrating a function of the control device.

The function and operation of the control device 500 according to the embodiment are further described below. FIG. 5 is a diagram for describing the function of the control device 500.

The control device 500 according to the embodiment includes the drying controller 510. The drying controller 510 according to the embodiment includes an input receiver 511; a temperature setting unit 512; an upper limit temperature storage unit 513; a temperature obtaining unit 514; a temperature comparison unit 515; and a heating controller 516.

The input receiver 511 receives an operation on the drying device 200. Specifically, the input receiver 511 receives an input representing the surface temperature of the heating roller for conveying the recording medium S.

The temperature setting unit 512 sets a target temperature for heating the heating roller to be the surface temperature of the heating roller input by the input receiver 511.

Note that, in the embodiment, for example, only the inputs representing the target temperatures of the upstream heating rollers 231 and 232 may be received by the input receiver 511. In other words, in the embodiment, for example, a setting screen for inputting only the target temperatures of the heating rollers 231 and 232 may be displayed on an operations panel of the drying device 200 or the printing device 300 to receive an input. In this case, the target temperatures of the downstream heating rollers 233 through 236 may be stored, in advance, in the drying controller 510.

The upper limit temperature storage unit 513 stores, for each heating rollers, an upper limit temperature. The upper limit temperature for each heating roller has been defined by a specification of the hearing roller. Note that the upper limit temperature storage unit 513 according to the embodiment may store only the upper limit temperatures for the upstream heating rollers 231 and 232, or may store the upper limit temperatures for the heating rollers 231 through 236.

The temperature obtaining unit 514 obtains a value of a temperature sensor provided for each heating roller.

The temperature comparison unit 515 compares the temperature obtained by the temperature obtaining unit 514 with the target temperature that is set. Furthermore, the temperature comparison unit 515 compares the temperature obtained by the temperature obtaining unit 514 with the upper limit temperature stored in the upper limit temperature storage unit 513.

The heating controller 516 controls on/off of the halogen lamp included in each heating roller based on the result of the comparison by the temperature comparison unit 515. In other words, the heating controller 516 switches between heating by the halogen lamp included in each heating roller and the termination of the heating. Furthermore, the heating controller 516 performs control to reduce a quantity of heat generated by the halogen lamp.

Figure 6:
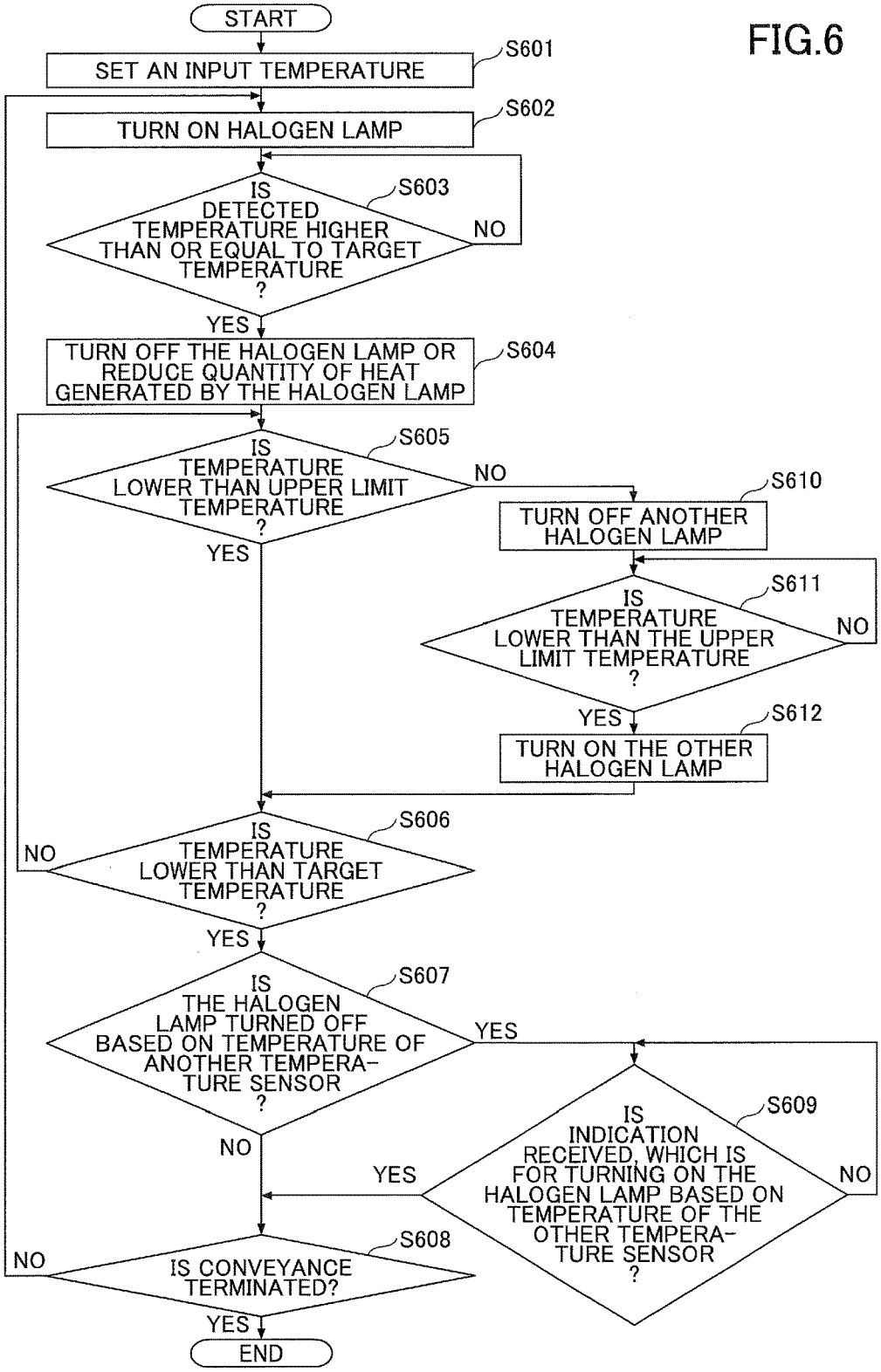
FIG. 6 is a first flowchart illustrating an operation of the control device.
Figure 7:
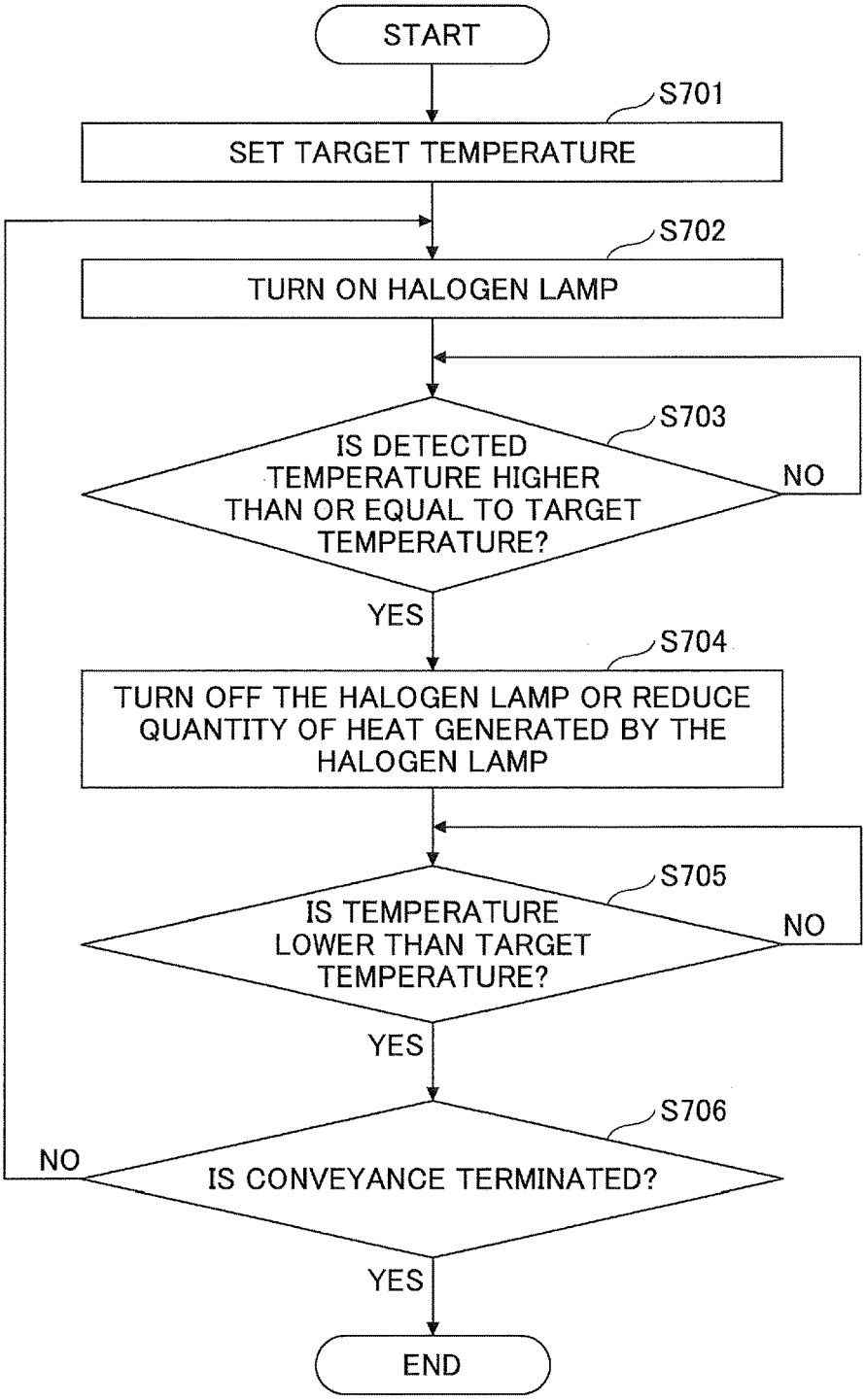
FIG. 7 is a second flowchart illustrating the operation of the control device.

Next, an operation of the control device 500 according to the embodiment is described by referring to FIG. 6 and FIG. 7. FIG. 6 is a first flowchart illustrating an operation of the control device. FIG. 6 illustrates the control of heating the upstream heating rollers 231 and 232 by the control device 500.

In the embodiment, the control device 500 controls the two halogen lamps included in the heating roller 231. Similarly, the control device 500 controls the two halogen lamps included in the heating roller 232. Accordingly, in FIG. 6, control of the halogen lamp 412 included in the heating roller 231 is described as an example of the control of the halogen lamps included in each of the heating rollers 231 and 232.

In the control device 500 according to the embodiment, the drying controller 510 receives an input representing the surface temperature of the heating roller 231 from the input receiver 511. Upon detecting that the conveyance of the recording medium S is started, the drying controller 510 causes the temperature setting unit 512 to set the target temperature of the heating roller 231 to be the input surface temperature (step S601).

Subsequently, the drying controller 510 causes the heating controller 516 to turn on the halogen lamp 412 to start heating (step S602). Subsequently, the drying controller 510 causes the temperature obtaining unit 514 to obtain the temperature detected by the temperature sensor 415, and the drying controller 510 causes the temperature comparison unit 515 to determine whether the obtained temperature is higher than or equal to the target temperature (step S603).

At step S603, in response to detecting that the temperature detected by the temperature sensor 415 is lower than the target temperature, the drying controller 510 waits until the temperature detected by the temperature sensor 415 reaches the target temperature.

At step S603, in response to determining that the temperature detected by the temperature sensor 415 is higher than or equal to the target temperature, the drying controller 510 causes the heating controller 516 to turn off the halogen lamp 412 or causes the heating controller 516 to reduce the quantity of heat generated by the halogen lamp 412 (step S604). Here, turning off the halogen lamp 412 means that heating by the halogen lamp 412 is continuously stopped for a predetermined time interval. However, instead of turning off the halogen lamp 412, a quantity heat generated by the halogen lamp 412 may be reduced by controlling a ratio of a time interval during which the halogen lamp 412 is turned on with respect to a predetermined time interval. Further, instead of turning off the halogen lamp 412, the heating controller 516 may reduce a quantity of heat generated by the halogen lamp 412 by repeatedly turning on and turning off the halogen lamp 412. Furthermore, instead of turning off the halogen lamp 412, the heating controller 516 may reduce a quantity of heat generated by the halogen lamp 412 by controlling a voltage input to the halogen lamp 412. Furthermore, in the embodiment, for example, at step S604, a setting may be made in the drying controller 510, in advance, as to whether the halogen lamp is turned off or a quantity of heat generated by the halogen lamp is reduced, and the heating controller 516 may perform control of the halogen lamp based on the setting.

Subsequently, the drying controller 510 causes the temperature comparison unit 515 to determine whether the temperature detected by the temperature sensor 415 is lower than the upper limit temperature of the halogen lamp 412 stored in the upper limit temperature storage unit 513 (step S605). In response to detecting, at step S605, that the temperature detected by the temperature sensor 415 is not lower than the upper limit temperature, namely, the temperature detected by the temperature sensor 415 is greater than or equal to the upper limit temperature, the drying controller 510 proceeds to step S610, which is described below.

At step S605, in response to detecting that the temperature detected by the temperature sensor 415 is lower than the upper limit temperature, the drying controller 510 causes the temperature comparison unit 515 to determine whether the temperature detected by the temperature sensor 415 is lower than the target temperature (step S606).

At step S606, in response to detecting that the temperature detected by the temperature sensor 415 is not lower than the target temperature, namely, the temperature detected by the temperature sensor 415 is higher than or equal to the target temperature, the drying controller 510 returns to step S605.

At step S606, in response to detecting that the temperature detected by the temperature sensor 415 is lower than the target temperature, the drying controller 510 determines whether the halogen lamp 412 is turned off based on the temperature of the temperature sensor 414 (step S607).

In the following, the determination at step S607 is described.

At step S607, a determination is made as to whether the halogen lamp 412 is turned off by detecting that the temperature detected by the temperature sensor 414 is higher than or equal to the upper limit temperature. In other words, the drying controller 510 determines whether the temperature detected by the temperature sensor 414 is higher than or equal to the upper limit temperature.

If the temperature detected by the temperature sensor 414 is higher than or equal to the upper limit temperature, the halogen lamp 412 is turned off within control of heating with respect to the halogen lamp 411. In this case, the halogen lamp 412 is not turned on, unless the temperature detected by the temperature sensor 414 becomes lower than the upper limit temperature.

At step S607, in response to detecting that the halogen lamp 412 is not turned off based on the temperature of the temperature sensor 414, the drying controller 510 determines whether a command for terminating the conveyance of the recording medium S is received (step S608). At step S608, upon detecting that a command for terminating the conveyance is not received, the drying controller 510 returns to step S602. At step S608, upon receiving a command for terminating the conveyance, the drying controller 510 terminates the process.

At step S607, in response to detecting that the halogen lamp 412 is turned off based on the temperature of the temperature sensor 414, the drying controller 510 determines whether the halogen lamp 412 is turned on based on the temperature of the temperature sensor (step S609). In other words, the drying controller 510 determines whether the temperature detected by the temperature sensor 414 becomes lower than the upper limit temperature.

At step S609, in response to detecting that the halogen lamp 412 is turned on based on the temperature detected by the temperature sensor 414, the drying controller 510 proceeds to step S608. At step S609, in response to detecting that the halogen lamp 412 is not turned on based on the temperature of the temperature sensor 414, the drying controller 510 waits until the halogen lamp 412 is turned on.

At step S605, in response to detecting that the temperature detected by the temperature sensor 415 becomes higher than or equal to the upper limit temperature, the drying controller 510 causes the heating controller 516 to turn off the halogen lamp 411 (step S610).

Subsequently, the drying controller 510 causes the temperature comparison unit 515 to determine whether the temperature detected by the temperature sensor 415 becomes lower than the upper limit temperature (step S611). At step S611, in response to detecting that the temperature detected by the temperature sensor 415 is not lower than the upper limit temperature, namely, the temperature detected by the temperature sensor 415 is higher than or equal to the upper limit temperature, the drying controller 510 waits until the temperature detected by the temperature sensor 415 becomes lower than the upper limit temperature.

At step S611, upon detecting that the temperature detected by the temperature sensor 415 becomes lower than the upper limit temperature, the heating controller 516 turns on the halogen lamp 411 (step S612), and the heating controller 516 proceeds to step S606.

As described above, according to the embodiment, an increase in the temperature of the non-sheet passing part is suppressed by controlling on/off of the halogen lamps 411 and 412 based on the temperatures detected by the temperature sensors 414 and 415 included in the heating roller 231. Consequently, according to the embodiment, an increase in a temperature of a non-sheet passing part can be suppressed without depending on the width of the recording medium S.

Next, control of the downstream heating rollers 233 through 236 by the control device 500 is described by referring to FIG. 7. FIG. 7 is a second flowchart illustrating an operation of the control device 500.

In the embodiment, the control device 500 similarly controls the halogen lamps included in the heating rollers 233 through 236. Accordingly, in FIG. 7, control of the halogen lamp included in the heating roller 233 is described as an example of the control of the halogen lamps included in each of the heating rollers 233 through 236.

In the drying controller 510 according to the embodiment, the temperature setting unit 512 sets a target temperature corresponding to the halogen lamp included in the heating roller 233 (step S701). Note that the target temperature that is to be set here may be a temperature received by the input receiver 511, or may be a temperature stored in advance.

The process from step S702 to step S704 in FIG. 7 is the same as the process from step S602 to step S604 in FIG. 6. Thus, the description of the process from step S702 to step S704 in FIG. 7 is omitted.

Subsequent to step S704, the drying controller 510 causes the temperature comparison unit 515 to determine whether the temperature detected by the temperature sensor for the heating roller 233 becomes lower than the target temperature (step S705). At step S705, upon detecting that the temperature is greater than or equal to the target temperature, the drying controller 510 waits until the temperature becomes the target temperature.

At step S705, upon detecting that the temperature becomes lower than the target temperature, the drying controller 510 determines whether a command for terminating the conveyance of the recording medium S is received (step S706). At step S706, upon detecting that a command for terminating the conveyance is not received, the drying controller 510 returns to step S702. At step S706, upon detecting that a command for terminating the conveyance is received, the drying controller 510 terminates the process.

Figure 8:
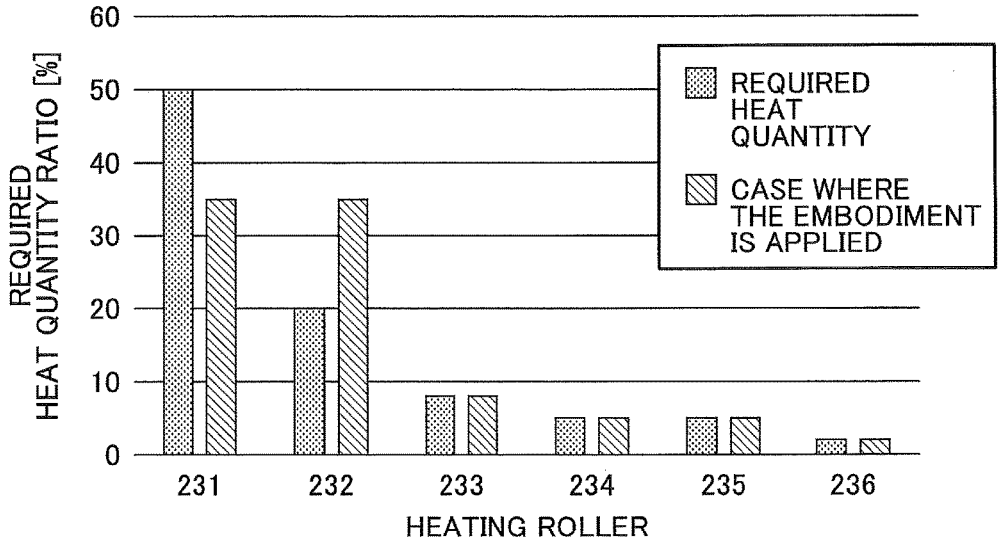
FIG. 8 is a diagram illustrating quantity of heat supplied to each heating roller.

FIG. 8 is a diagram illustrating the temperature of each heating roller. FIG. 8 is a conceptual diagram illustrating ratios of quantities of heat supplied from the heating rollers 231 through 236 when the quantity of heat required for drying the recording medium S is defined to be 100%.

It is preferable that, in the drying device 200 according to the embodiment, by rapidly applying heat quantities to the upstream heating rollers 231 and 232, the temperature of the recording medium S be kept at a certain constant temperature.

The certain constant temperature is a temperature at which the heat of the downstream rollers 233 through 236 is not absorbed by the recording medium S. In other words, the certain constant temperature is approximately the same as the surface temperature of the downstream heating rollers 233 through 236.

Consequently, as illustrated in FIG. 8, in the embodiment, heat generation by the heating rollers 231 and 232 is controlled, so that a quantity of heat that is approximately the same as the required quantity of heat is supplied to the recording medium S by the upstream heating rollers 231 and 232 (i.e., the heating rollers that can supply the same quantities of heat).

In the embodiment, by providing the heating rollers 231 and 232 having the same configurations (namely, the heating rollers 231 and 232 can supply the same quantities of heat), for example, even if the required quantity of heat may not be supplied to the recording medium S by the heating roller 231, the remaining quantity of heat can be compensated for by the subsequent heating roller 232.

When the required quantity of heat is not supplied by the heating roller 231, the temperature of the recording medium S is lowered. When the temperature of the recording medium S is low, at the subsequent heating roller 232, the low-temperature recording medium S absorbs a more quantity of heat from the heating roller 232. Thus, in order to maintain the temperature at the target temperature, a large quantity of heat is consequently generated by the heating roller 232 (the halogen lamp). In the embodiment, a configuration is adopted to provide two heating rollers 231 and 232 that can supply the same quantities of heat that are approximately equivalent to the required quantity of heat. However, the number of such heating rollers may be more than two. In that case, it is possible to dry a recording medium whose width is narrower than the width of a recording medium when there are two such heating rollers. The quantities of heat that can be supplied by the heating rollers 231 and 232 having the same configurations may not be the same. The configurations of respective heating rollers 232, 233, and 234 may be determined, so that the quantity of the heat that is not supplied by the heating roller 232 can be compensated for by the quantities of heat shared by the subsequent heating rollers 233 and 234. For example, a configuration may be adopted such that the quantities of heat that can be supplied by the heating rollers 231 through 236 are sequentially decreased in this order.

Figure 9:
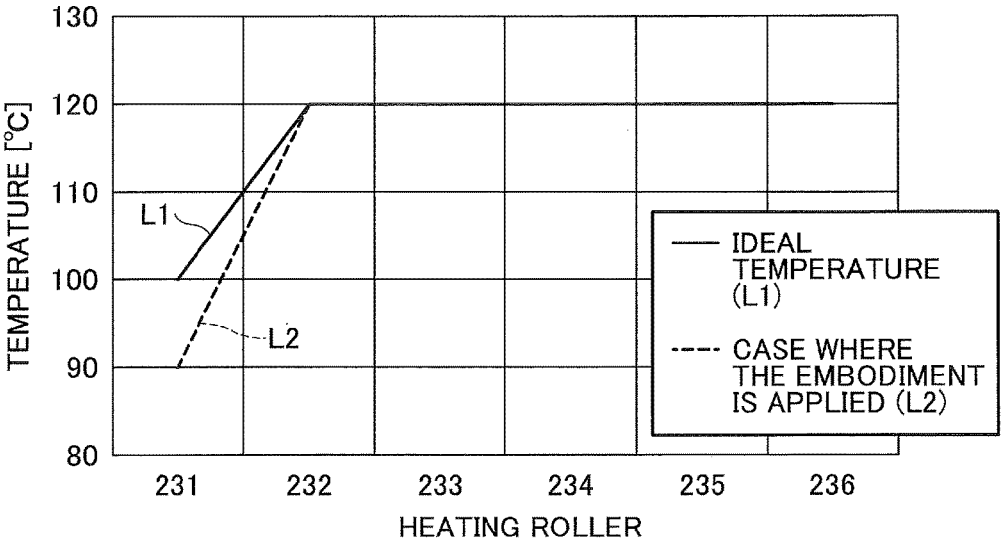
FIG. 9 is a diagram illustrating temperature of each heating roller.

FIG. 9 is a diagram illustrating the temperature of each heating roller. FIG. 9 is a conceptual diagram illustrating the surface temperature when the recording medium S passes through each heating roller.

In the graph L2 that indicates the temperature of each heating roller according to the embodiment, the surface temperature of the heating roller 231 is lower than the surface temperature of the heating roller 231 indicated by the graph L1 that indicates the ideal temperature of each heating roller.

This indicates that, when the recording medium S is conveyed by the heating roller 231, the halogen lamp included in the heating roller 231 is turned off so as to suppress an increase in the temperature of the non-sheet passing part.

According to the embodiment, in such a case, the decreased amount of the quantity of heat of the heating roller 231 is compensated for by the subsequent heating roller 232. Namely, the drying device 200 according to the embodiment is configured such that, in the multiple heating rollers, even if, at the subsequent heating roller, the quantity of heat is insufficient due to suppressing an increase in the temperature of the preceding heating roller itself, the remaining quantity of heat is automatically compensated for by the subsequent heating roller. Consequently, according to the embodiment, it is possible to ensure the print quality while suppressing the temperature rise in the non-sheet passing part. Note that in the embodiment, two heating rollers are provided, each of which can supply the quantity of heat that is approximately the same as the quantity of heat required for drying the recording medium S. However, three such heating rollers may be provided. For example, when three such heating rollers are provided, the recording medium S can be dried, even if the width of the recording medium S is small and the non-sheet passing parts in the heating rollers are wide. The reason is described below.

When the width of the recording medium S is small and the area corresponding to the non-sheet passing part is wide, the quantity of heat removed from the heating roller by the recording medium S is small, compared to a case where the width of the recording medium S is large and the area corresponding to the non-sheet passing part is narrow. Consequently, the temperature of the halogen lamp rapidly increases. Upon determining that the detected temperature is higher than or equal to the target temperature, the halogen lamp is turned off. In other words, when the width of the recording medium S is small and the area corresponding to the non-sheet passing part is wide, supply of heat from one heating roller to the recording medium S may be terminated in a short time. In such a case, if there are three or more heating rollers, each of which can supply the quantity of heat that is approximately the same as the quantity of heat required for drying the recording medium S, the quantity of heat required for drying the recording medium S can be supplied to the recording medium S, even if the time intervals for supplying heat by the respective heating rollers are short.

Further, in the embodiment, the quantity of heat supplied by the heating roller 231 may not be the same as the quantity of heat supplied by the heating roller 232. For example, in the embodiment, the supply of the quantity of heat that can compensate for the quantity of heat that may not be supplied by the heating roller 232 may be shared by the subsequent heating rollers, such as the heating rollers 233 and 234. For example, the quantities of heat supplied by the respective rollers may be sequentially reduced from the heating roller 231 toward the subsequent heating roller 236. In other words, the quantities of heat supplied to the recording medium S from the heating rollers 231 through 236 may be gradually reduced in the order that starts from the heating roller 231 disposed at an upstream side in the conveyance direction of the recording medium S.

Figure 10:
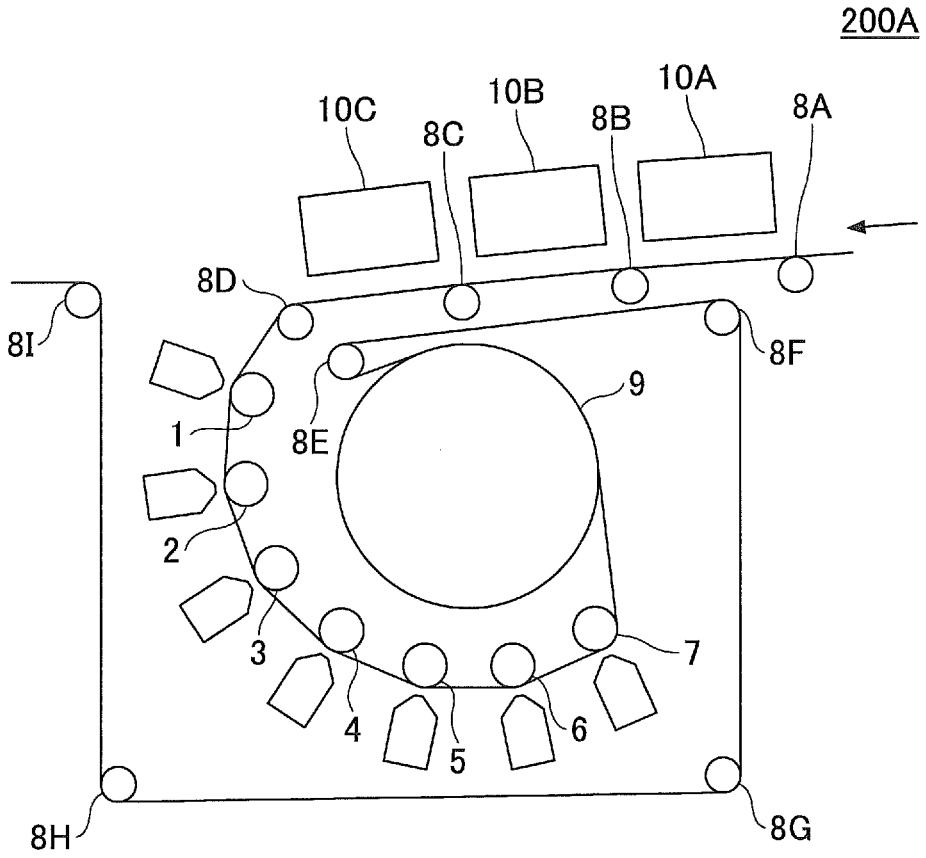
FIG. 10 is a diagram illustrating a modified example of the drying device.

Next, a modified example of the drying device 200 according to the embodiment is described by referring to FIG. 10. FIG. 10 is a diagram illustrating the modified example of the drying device.

The drying device 200A illustrated in FIG. 10 is configured such that a heating roller is wound around only one side of the recording medium S.

The drying device 200A includes heating rollers 1 through 7 and a plurality of guide rollers 8A through 8I. Here, the heating rollers 1 through 7 are arranged so as to circumferentially surround a heating drum 9. The heating roller 1 is arranged at a position contacting a reverse side of the recording medium S, which is opposite to the image forming side of the recording medium S on which an image is formed. Furthermore, each of the heating rollers 1 through 7 is a contact component for contacting the recording medium S. The each of the heating rollers 1 through 7 has a predetermined curvature. The recording medium S closely contacts a contact surface over the entire range in a width direction that is a direction perpendicular to the sheet conveyance direction of the recording medium S in a contact range in the sheet conveyance direction.

Between adjacent rollers of the guide rollers 8A through 8D, radiation heating units 10A through 100 are provided, which are for heating, in a contactless manner, liquid discharged on the recording medium S in a contactless manner. The recording medium S that passes through the heating roller 7 is guided to the heating drum 9.

In the drying device 200A illustrated in FIG. 10, the heating roller 1 located at the upstream most position in the sheet conveyance direction of the recording medium S and the subsequent heating roller 2 are configured to be the same as the heating roller 231 and the heating roller 232, respectively.

Consequently, in the drying device 200A, an increase in the temperature of the non-sheet passing part can be suppressed irrespective of the width of the recording medium S. Furthermore, in the embodiment, the end part of the light emitting region of each halogen lamp, which is the heating source, is located in the vicinity of the corresponding edge of the heating roller. Accordingly, for example, in a drying system in which a conveyance reference for drying a front surface of a recording medium S is at one edge of a heating roller and a conveyance reference for drying the reverse surface of the recording medium S is at the other edge of the heating roller, the same heating roller can be used for drying the front surface and the reverse surface of the recording medium S. In other words, when the embodiment is applied to a drying system with three drying steps such that, when both surfaces of the recording medium S are to be printed, after drying the recording medium S in which the front surface is printed, the recording medium S in which the reverse surface is printed is dried, and subsequently the front surface is dried again, the same heating roller can be used for drying both the front surface and the reverse surface.

The present invention is not limited to the specifically disclosed embodiments, and variations and modifications may be made without departing from the scope of the present invention.

The present application is based on and claims the benefit of priority of Japanese priority application No. 2016-142131 filed on Jul. 20, 2016, and Japanese priority application No. 2017-134156 filed on Jul. 7, 2017, the entire contents of which are hereby incorporated herein by reference.

What is claimed is:

1. A drying device provided with a roller, wherein the drying device is for drying a recording medium conveyed by rotation of the roller, the drying device comprising:

a first heating source and second heating source that are included inside the roller;

a first temperature detector configured to detect a temperature of a first region on a surface of the roller, wherein the first region is in a vicinity of the first heating source, and the first region is heated by the first heating source;

a second temperature detector configured to detect a temperature of a second region on the surface of the roller, wherein the second region is in a vicinity of the second heating source, and the second region is heated by the second heating source; and a heating controller configured to control heating and termination of the heating by the first heating source and/or the second heating source, wherein, in a direction of an axis of the roller, a shortest distance between the first temperature detector and the first heating source is less than a shortest distance between the first temperature detector and the second heating source, wherein, in the direction of the axis of the roller, a shortest distance between the second temperature detector and the second heating source is less than a shortest distance between the second temperature detector and the first heating source, wherein, upon detecting that a temperature of the first region is higher than or equal to a predetermined temperature while heating by the first heating source is terminated, the heating controller is configured to terminate heating by the second heating source, and wherein, upon detecting that a temperature of the second region is higher than or equal to the predetermined temperature while heating by the second heating source is terminated, the heating controller is configured to terminate heating by the first heating source.

2. The drying device according to claim 1, wherein the first heating source and the second heating source are arranged so that a width from one of end parts of a first light emitting region of the first heating source farthest from the second heating source to one of end parts of a second light emitting region of the second heating source farthest from the first heating source is greater than or equal to a maximum width of the recording medium.

3. The drying device according to claim 1, wherein the drying device includes a plurality of sets, each of the plurality of sets including the roller, the first temperature detector, and the second temperature detector, the first heating source and the second heating source being included inside the roller.

4. The drying device according to claim 1, wherein upon detecting that the temperature of the one region of the first region and the second region is higher than or equal to a target temperature, the target temperature being lower than the predetermined temperature, the heating controller is configured to terminate heating or to reduce a quantity of heat generated by the other heating source of the first heating source and the second heating source, the other heating source corresponding to the one region.

5. The drying device according to claim 1, wherein the drying device includes a plurality of the rollers arranged in an order from an upstream side in a direction of conveyance of the recording medium, wherein, upon detecting that the temperature of the one region of the first region and the second region is higher than or equal to the predetermined temperature, for a predetermined number of the rollers of the plurality of rollers in the order from the upstream side in the direction of the conveyance of the recording medium, the heating controller is configured to terminate heating by the one heating source of the first heating source and the second heating source, the one heating source corresponding to the other region.

6. The drying device according to claim 5, wherein the plurality of the rollers are configured so that quantities of heat that can be supplied by the respective plurality of heating rollers are sequentially reduced in the order from the upstream side in the direction of the conveyance of the recording medium.

7. The drying device according to claim 1, wherein the first heating source overlaps the second heating source in the direction of the axis of the roller.

8. A control device for controlling a drying device including a roller, a first heating source and a second heating source being included inside the roller, wherein the drying device is for drying a recording medium conveyed by rotation of the roller, the control device comprising:

a temperature obtaining unit configured to obtain a temperature of a first region and a temperature of a second region, wherein the temperature obtaining unit is configured to obtain the temperature of the first region from a first temperature detector configured to detect the temperature of the first region on a surface of the roller, wherein the first region is in a vicinity of the first heating source, and the first region is heated by the first heating source, and wherein the temperature obtaining unit is configured to obtain the temperature of the second region from a second temperature detector configured to detect the temperature of the second region on the surface of the roller, wherein the second region is in a vicinity of the second heating source, and the second region is heated by the second heating source; and a heating controller, wherein, in a direction of an axis of the roller, a shortest distance between the first temperature detector and the first heating source is less than a shortest distance between the first temperature detector and the second heating source, wherein, in the direction of the axis of the roller, a shortest distance between the second temperature detector and the second heating source is less than a shortest distance between the second temperature detector and the first heating source, wherein, upon detecting that a temperature of the first region is higher than or equal to a predetermined temperature while heating by the first heating source is terminated, the heating controller is configured to terminate heating by the second heating source, and wherein, upon detecting that a temperature of the second region is higher than or equal to the predetermined temperature while heating by the second heating source is terminated, the heating controller is configured to terminate heating by the first heating source.

9. A drying method executed in a drying device, wherein the drying device includes a roller, a first heating source and a second heating source being included inside the roller, wherein the drying device is for drying a recording medium conveyed by rotation of the roller, the drying method comprising:

obtaining, by the drying device, a temperature of a first region and a temperature of a second region, wherein the temperature of the first region is obtained from a first temperature detector for detecting the temperature of the first region on a surface of the roller, wherein the first region is in a vicinity of the first heating source, and the first region is heated by the first heating source, and wherein the temperature of the second region is obtained from a second temperature detector for detecting the temperature of the second region on the surface of the roller, wherein the second region is in a vicinity of the second heating source, and the second region is heated by the second heating source, wherein, in a direction of an axis of the roller, a shortest distance between the first temperature detector and the first heating source is less than a shortest distance between the first temperature detector and the second heating source, and wherein, in the direction of the axis of the roller, a shortest distance between the second temperature detector and the second heating source is less than a shortest distance between the second temperature detector and the first heating source;

upon detecting that a temperature of the first region is higher than or equal to a predetermined temperature while heating by the first heating source is terminated, terminating, by the drying device, heating by the second heating source, and upon detecting that a temperature of the second region is higher than or equal to the predetermined temperature while heating by the second heating source is terminated, terminating, by the drying device, heating by the first heating source.

* * * * *